United States Patent [19]

Tallent

[11] Patent Number: 4,831,754

[45] Date of Patent: May 23, 1989

[54] AWARDS SHOWCASE

[76] Inventor: Claude E. Tallent, 17 Higdon Ct., Ft. Walton Beach, Fla. 32548

[21] Appl. No.: 141,478

[22] Filed: Jan. 7, 1988

[51] Int. Cl.[4] ..... A47G 1/06; G09F 1/12

[52] U.S. Cl. ..... 40/152

[58] Field of Search ..... 40/152, 152.1, 160, 40/16, 17, 611, 201; 312/114

[56] References Cited

U.S. PATENT DOCUMENTS

| | | | |
|---|---|---|---|
| 2,057,461 | 10/1936 | Walton . | |
| 2,206,281 | 7/1940 | Goeller | 40/64 |
| 2,521,792 | 9/1950 | Hollander . | |
| 3,659,365 | 5/1972 | Eaton | 40/16 |
| 3,792,543 | 2/1974 | Powell . | |
| 3,803,738 | 4/1974 | Weiss | 40/306 |
| 3,924,344 | 12/1975 | Davis | 40/129 |
| 4,041,630 | 8/1977 | Holbrook . | |
| 4,149,331 | 4/1979 | Prager . | |
| 4,566,211 | 1/1986 | Gustafson et al. | 40/605 |
| 4,715,138 | 12/1987 | Cherico . | |

*Primary Examiner*—Robert Peshock
*Assistant Examiner*—Michael Lynch
*Attorney, Agent, or Firm*—Oltman and Flynn

[57] ABSTRACT

A showcase having a rectangular frame closed at the back and a slidably insertable and removable transparent front frame. One side and the top and bottom pieces of the frame have grooves for slidably receiving the front pane along its corresponding edges. The other side piece has a longitudinal side-to-side opening through which the front pane is slidably inserted and removed, and a front-to-back recess which intersects the opening. A retainer pin is removably positioned in this recess to hold the front pane in place.

3 Claims, 2 Drawing Sheets

FIG. 1
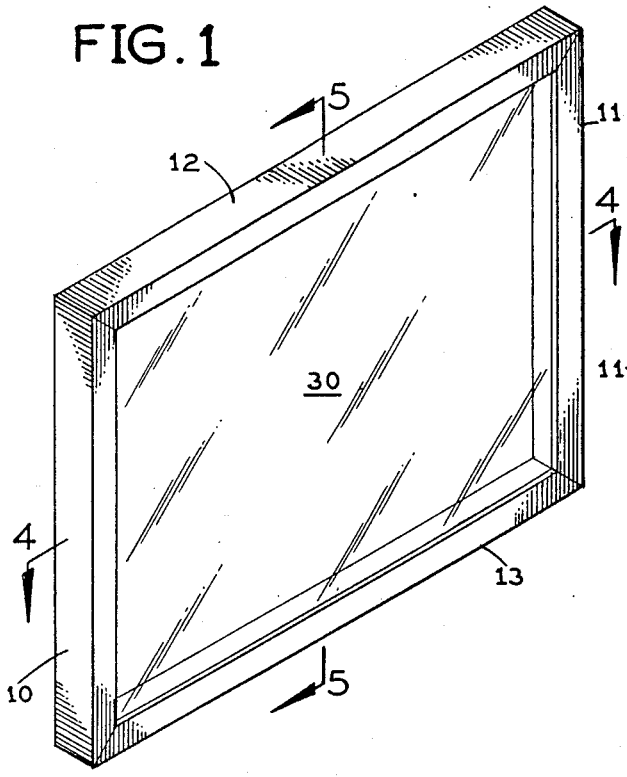
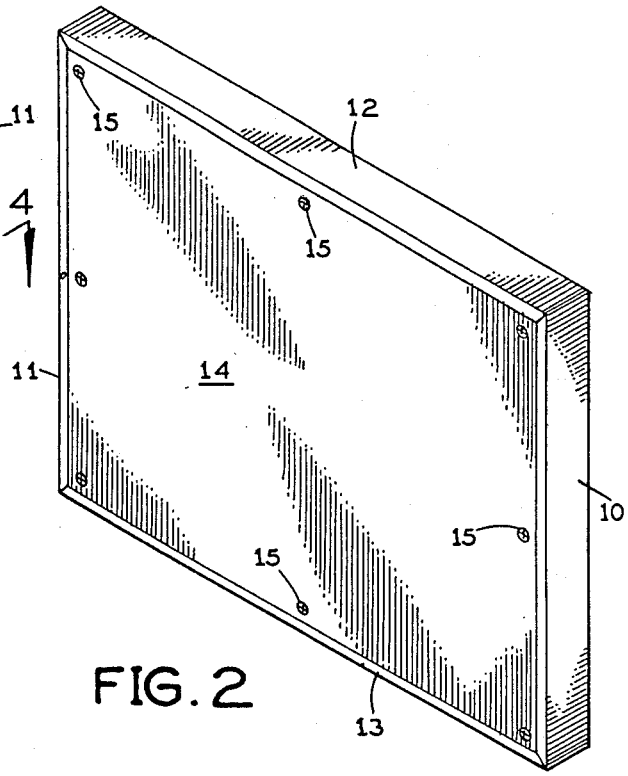
FIG. 2
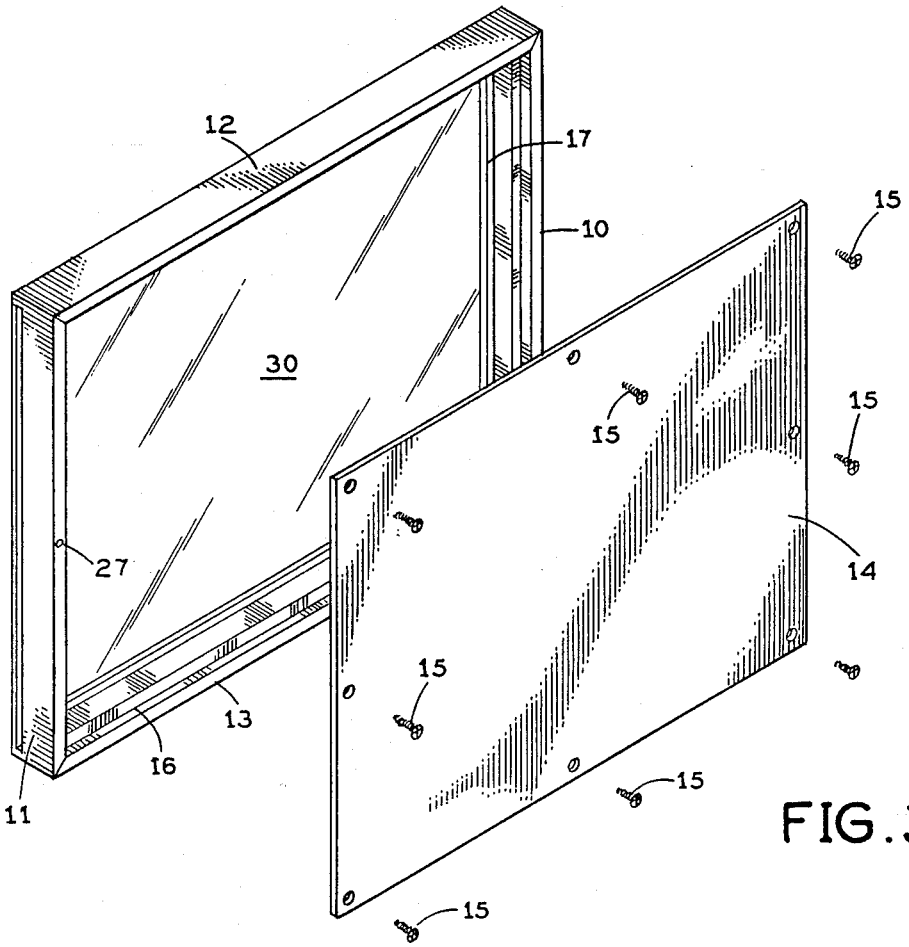
FIG. 3

AWARDS SHOWCASE

SUMMARY OF THE INVENTION

This invention relates to a showcase for displaying medals, ribbons, diplomas, awards and the like.

A principal object of this invention is to provide a novel showcase with a slidably insertable and removable transparent front pane which is held in place by a removable retainer pin.

Another object of this invention is to provide such a showcase which is constructed and arranged to be mounted on a vertical support, such as the wall of a room.

Preferably, the present invention comprises a rectangular frame with aligned slots along the inside edges of its top and bottom pieces and one side piece and an opening in the other side piece through which a removable transparent front pane is slidably insertable for snug reception in the slots in the top and bottom pieces and the one side piece. A retainer pin is removably positioned in the side piece with the opening to hold the transparent pane in place.

Further objects and advantages of this invention will be apparent from the following detailed description of a presently preferred embodiment which is illustrated schematically in the accompanying drawings.

DESCRIPTION OF THE DRAWINGS

FIG. 1 is a front perspective view of the present showcase;

FIG. 2 is a back perspective view;

FIG. 3 is an exploded perspective view, taken from behind the showcase;

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 4:
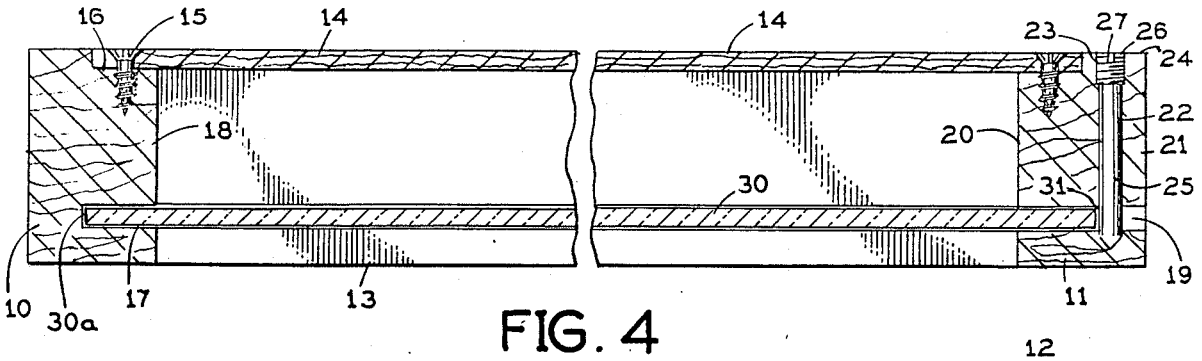
FIG. 4 is a horizontal cross-section taken along the line 4—4 in FIG. 1.
Figure 5:
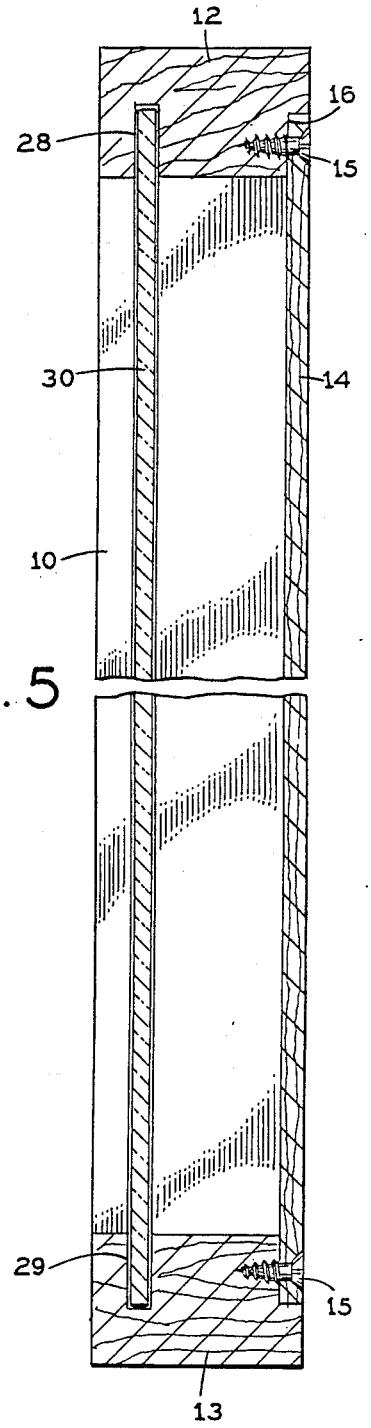
FIG. 5 is a vertical cross-section taken along the line 5—5 in FIG. 1.

Referring to FIG. 1, the present showcase has a rectangular frame made up of first and second opposite side pieces 10 and 11, a top piece 12 extending between the side pieces at their upper ends, and a bottom piece 13 extending between the side pieces at their lower ends. The side, top and bottom pieces are suitably joined to each other at the four corners of the frame. A flat rectangular back panel 14 (FIG. 2) is attached to the side, top and bottom pieces of the frame by screws 15. As shown in FIG. 3, the side, top and bottom pieces of the frame are recessed at 16 along the back to receive the back panel 14 so that when the back panel is in place it lies flush with the back face of the frame, i.e., its back face is coplanar with the back faces of the side, top and bottom pieces of the frame, as shown in FIGS. 2, 4 and 5. Preferably, a fabric such as black velvet (not shown) covers the inside face of the back panel to provide an appropriate decorative backing for the articles to be displayed.

Referring to FIG. 4, the first side piece 10 of the frame is formed with a groove 17 which is open along its iside face 18 (i.e., the face toward the opposite side piece 11). Groove 17 is of rectangular cross-section and it extends straight along the full length of the first side piece 10 between the top and bottom pieces 12 and 13. Groove 17 is located nearer the front face than the back face of side piece 10.

The second side piece 11 of the frame has a side-to-side opening 19 of the same front-to-back depth as groove 17 and aligned with it. Opening 19 extends completely through the second side piece 11 between its inner face 20 (i.e., the face toward side piece 10) and its outer face 21 along the entire height of the second side piece between the bottom and top pieces 13 and 12 of the frame.

The second side piece 11 also has a horizontal recess in the form of a blind hole 22 which extends from back to front in this side piece and intersects the hole 19 closes to the outer face 21 than to the inner face 20 of this side piece. Recess 22 has a counterbore 23 which is open at the back face 24 of the second side piece 11. Recess 22 terminates at its front end within the thickness of side piece 11 in front of the side-to-side opening 19.

A retainer pin 25 is removably received slidably but snugly in the front-to-back recess 22 in the second side piece 11. Pin 25 has a screw-threaded head 26 with a screw driver slot 27 that is threadedly received in counterbore 23 when pin 25 is fully inserted.

The top piece 12 of the frame has a straight longitudinal recess 28 of rectangular cross-section (FIG. 5) which registers at its opposite ends with the recess 17 in the first side piece 10 and the side-to-side opening 19 in the second side piece 11 at their upper ends.

The bottom piece 13 of the frame has a straight longitudinal recess 29 of rectangular cross-section which registers at its opposite ends with the recess 17 in the first side piece 10 and the opening 19 in the second side piece 11 at their lower ends.

Figure 6:
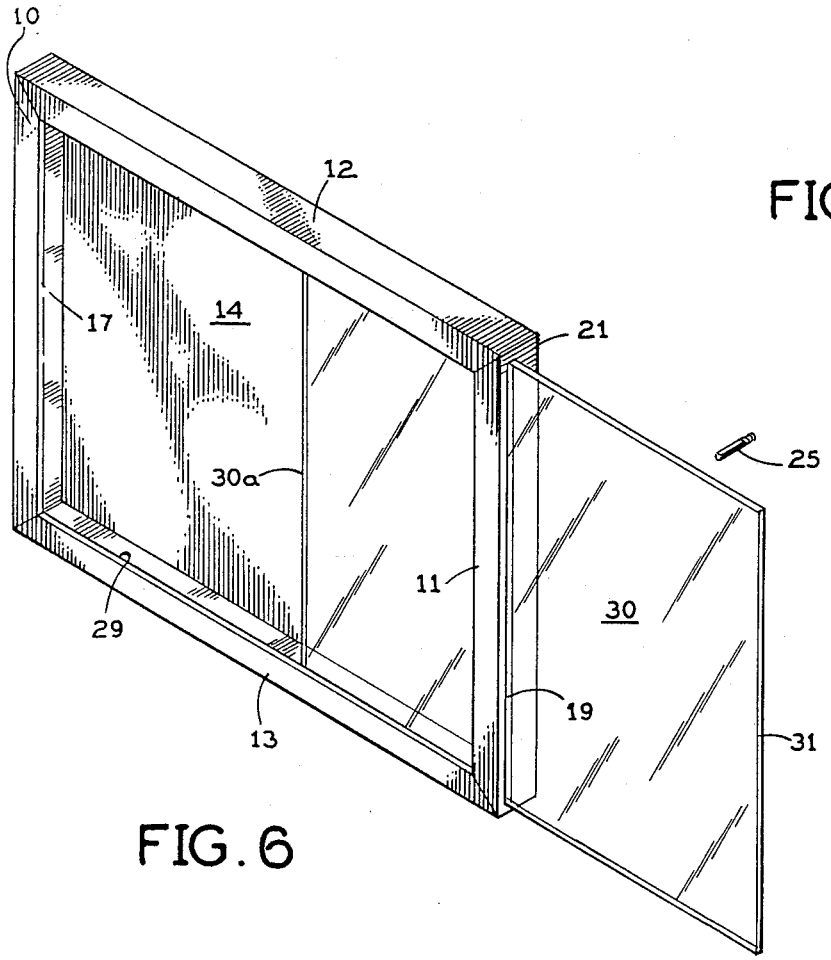
FIG. 6 is a front perspective view of the showcase with the transparent front pane only partly inserted.

The showcase has a flat transparent front pane 30 which, as shown in FIG. 6, is slidably insertable through the opening 19 in the second side piece 11 from its outer face 21, sliding along the recesses 28 and 29 in the top and bottom pieces 12 and 13 until it reaches the recess 17 in the first end piece 10. After this front pane 30 is fully inserted (FIG. 4), with its leading edge 30a against the bottom of groove 17, it presents a vertical side edge 31 which is located in the opening 19 in the second side piece 11 just past the front-to-back recess 22 in the direction toward the inner edge of this side piece. When the retainer pin 25 is inserted into recess 22 and screwed in place, it holds the front pane 30 in place extending across the front of the frame parallel to the back panel 14.

It will be evident that with this arrangement the transparent front pane 30 is firmly seated in place in the frame but is easily removable when the articles on display in the showcase are to be changed or positioned.

I claim:

1. A showcase comprising:

a rectangular back panel for holding articles to be displayed;

a rectangular frame attached to and positioned in front of said back panel, said frame comprising first and second opposite side pieces extending along opposite side edges of said back panel, a top piece extending between said side pieces along the top edge of said back panel, and a bottom piece extending between said side pieces along the bottom edge of said back panel;

said first side piece having a straight longitudinal recess which is open along its inner edge facing toward said second side piece;

said second side piece having a longitudinal opening therein extending across its width from its inner edge facing toward said first side piece to its outer edge away from said first side piece, said opening being aligned with said recess in said first side piece, said second side piece having a recess extending in a back-to-front direction and intersecting said opening between said outer and inner edges of said second side piece and between said top and bottom pieces;

said top piece having a straight longitudinal recess along the bottom which registers at its opposite ends with said recess in said first side piece and said opening in said second side piece;

said bottom piece having a straight longitudinal recess along the top which registers at its opposite ends with said recess in said first side piece and said opening in said second side piece;

and a flat transparent front pane slidably insertable into a said opening in said second side piece at its outer face, said pane being snugly but slidably received in said recesses in said first side piece and said top and bottom pieces and in said opening in said second side piece, said front pane presenting a side edge located in said opening next to said recess in said second side piece toward its inner edge;

and a retainer pin removably received in said recess in said second side piece and extending across said opening next to said side edge of said front pane and holding said front pane in place in the frame.

2. A showcase according to claim 1 wherein:

said recess in said second side piece is a blind hole which is open at the back and closed at the front of the frame.

3. A showcase according to claim 2 wherein:

said pin is screw-threadedly received in said recess in said second side piece.

* * * * *